US011187012B2

(12) United States Patent
Ellis et al.

(10) Patent No.: US 11,187,012 B2
(45) Date of Patent: Nov. 30, 2021

(54) INLINE MOTORIZED LOCK DRIVE FOR SOLENOID REPLACEMENT

(71) Applicant: Sargent Manufacturing Company, New Haven, CT (US)

(72) Inventors: David Ellis, Milford, CT (US); Scott B. Lowder, Orange, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 16/751,235

(22) Filed: Jan. 24, 2020

(65) Prior Publication Data

US 2020/0263451 A1 Aug. 20, 2020

Related U.S. Application Data

(63) Continuation of application No. 14/412,259, filed as application No. PCT/US2013/054352 on Aug. 9, 2013, now Pat. No. 10,570,645.

(Continued)

(51) Int. Cl.
*E05B 63/08* (2006.01)
*E05B 47/00* (2006.01)

(Continued)

(52) U.S. Cl.
CPC ..... *E05B 63/08* (2013.01); *E05B 47/0012* (2013.01); *E05B 47/0673* (2013.01);

(Continued)

(58) Field of Classification Search
CPC ..... E05B 204/003; E05B 204/0031; E05B 2047/003; E05B 2047/0031
See application file for complete search history.

(56) References Cited

U.S. PATENT DOCUMENTS 5,083,122 A 1/1992 Clark
5,628,216 A 5/1997 Qureshi et al.

(Continued)

FOREIGN PATENT DOCUMENTS

CN 102170765 A * 8/2011 ..... E05B 47/0012
TW M365969 U * 10/2009

(Continued)

OTHER PUBLICATIONS

International Search Report and Written Opinion for International Application No. PCT/US2013/054352, dated Jan. 24, 2014.

(Continued)

*Primary Examiner* — Alyson M Merlino
(74) *Attorney, Agent, or Firm* — Wolf, Greenfield & Sacks, P.C.

(57) ABSTRACT

An inline motorized lock drive is mountable within a lock housing to drive a sliding locking element between a locked and unlocked position. The lock drive includes a reversible motor having a shaft with an auger thereon to drive a lock spring, which drives the locking element. The sliding motion of the locking element is axially aligned with the motor axis to substantially reduce friction. The lock drive is preferably modular and emulates a solenoid lock drive with a control circuit. The control circuit is connected to drive the motor is switchable to default to a locked position or an unlocked position and emulate a "fail safe" or a "fail secure" type solenoid lock drive. The control circuit operates on 12 or 24 volts to replace solenoid locks of either voltage and stores power when power is applied, then uses the stored power to return the lock drive to the selected default state when power is removed.

11 Claims, 10 Drawing Sheets

Related U.S. Application Data

(60) Provisional application No. 61/683,455, filed on Aug. 15, 2012.

(51) Int. Cl.
*E05B 47/06* (2006.01)
*E05C 1/08* (2006.01)

(52) U.S. Cl.
CPC ..... *E05C 1/08* (2013.01); *E05B 2047/003* (2013.01); *E05B 2047/0031* (2013.01); *E05B 2047/0058* (2013.01); *E05B 2047/0073* (2013.01); *E05B 2047/0076* (2013.01); *Y10T 292/1021* (2015.04)

(56) References Cited

U.S. PATENT DOCUMENTS 5,640,863 A * 6/1997 Frolov ..... E05B 47/0692 70/283
5,715,715 A 2/1998 Nunez
5,876,073 A * 3/1999 Geringer ..... E05B 47/0673 292/144
5,931,430 A 8/1999 Palmer
6,076,870 A 6/2000 Frolov
6,082,791 A 7/2000 Frolov et al.
6,286,347 B1 * 9/2001 Frolov ..... E05B 47/0692 70/277
7,918,114 B2 4/2011 Walsh, III
8,302,438 B2 11/2012 Lui
8,356,499 B2 1/2013 Peng
8,739,586 B2 6/2014 Yuan
9,181,730 B1 11/2015 Peng
9,303,433 B2 4/2016 Chiou
9,316,025 B2 4/2016 Lien
9,340,998 B2 5/2016 Mani
9,834,959 B2 12/2017 Mani et al.
10,392,836 B2 8/2019 Mani et al.
10,465,423 B2 11/2019 Wong et al.
2004/0099026 A1 * 5/2004 Nunez ..... E05B 47/0673 70/283
2005/0050928 A1 3/2005 Frolov
2005/0121982 A1 6/2005 Hyde et al.
2010/0031714 A1 * 2/2010 Brown ..... E05B 47/00 70/277
2010/0122561 A1 5/2010 Lui
2010/0294008 A1 * 11/2010 Bogdanov ..... E05B 47/0692 70/277
2011/0056253 A1 * 3/2011 Greiner ..... E05B 47/0002 70/277
2011/0079057 A1 4/2011 Frolov et al.
2011/0203331 A1 8/2011 Picard et al.
2012/0198897 A1 8/2012 Lui
2012/0212001 A1 * 8/2012 Benitez ..... E05B 17/22 292/251.5
2015/0184425 A1 7/2015 Ellis et al.
2016/0060904 A1 3/2016 Dore Vasudevan
2018/0258666 A1 9/2018 Wong et al.

FOREIGN PATENT DOCUMENTS

TW M395716 U * 1/2011
WO WO-9934079 A1 * 7/1999 ..... E05B 47/026

OTHER PUBLICATIONS

International Preliminary Report on Patentability for International Application No. PCT/US2013/054352, dated Feb. 26, 2015.
U.S. Appl. No. 16/580,035, filed Sep. 24, 2019, Wong et al.
U.S. Appl. No. 14/412,259, filed Dec. 31, 2014, Ellis et al.
PCT/US2013/054352, Jan. 24, 2014, International Search Report and Written Opinion.
PCT/US2013/054352, Feb. 26, 2015, International Preliminary Report on Patentability.

* cited by examiner

INLINE MOTORIZED LOCK DRIVE FOR SOLENOID REPLACEMENT

RELATED APPLICATIONS

This Application is a Continuation of U.S. application Ser. No. 14/412,259, filed Dec. 31, 2014, titled "INLINE MOTORIZED LOCK DRIVE FOR SOLENOID REPLACEMENT", which is a national stage filing under 35 U.S.C. 371 of International Patent Application Serial No. PCT/US2013/054352, filed Aug. 9, 2013, titled "INLINE MOTORIZED LOCK DRIVE FOR SOLENOID REPLACEMENT", which claims the benefit under 35 USC 119(e) of U.S. Application Ser. No. 61/683,455, filed Aug. 15, 2012, titled "INLINE MOTORIZED LOCK DRIVE FOR SOLENOID REPLACEMENT", each of which is incorporated by reference herein.

TECHNICAL FIELD

The present invention relates to electromechanical locks having a lock drive that switches the lock between a locked state and an unlocked state responsive to an electrical signal. More specifically, the invention relates to improving the electrical and mechanical efficiency of the lock drive. The invention further relates to improving manufacturability of such locks.

BACKGROUND ART

There is a very large installed base of solenoid-type electromechanical locks. Solenoid-type locks use a solenoid as the lock drive to move a locking element within the lock between a locked position and an unlocked position. In the locked position, the locking element is moved into interfering engagement with a lock component to prevent retraction of the latchbolt. In the unlocked position, the locking element is moved to a position that allows the latchbolt to be freely retracted.

The solenoid in a solenoid-type lock drive is typically powered by a solenoid lock control system having one of two operating voltages, 12 or 24 volts, which are standard in the industry. The solenoid lock control system may be a local control system mounted on or near the door to send power to its associated lock, or it may be a centralized system operating multiple doors independently or in concert to lock or unlock doors on a timed schedule, responsive to emergency conditions or for other reasons.

The solenoid of a solenoid-type lock drive is spring biased to a default state, which may be either the locked or unlocked state, depending on the intended application of the lock. When power is applied to the lock by the solenoid-type control system, the solenoid moves away from its default locked or unlocked state against the biasing spring force. As long as power is applied to the lock drive in the lock, the solenoid drive remains in its non-default state. As soon as power is removed by the control system the lock returns to its default state.

This feature of a solenoid-type lock drive—in which a spring in the lock automatically returns the lock to its default state—is relied upon in emergency conditions to ensure that the locks are all in a known locked or unlocked state when all power is removed. When the solenoid is spring biased to the locked position, the lock is referred to as a "fail secure" lock. When it is spring biased to the unlocked position the lock is referred to as a "fail safe" lock. Thus, there are four industry-standard solenoid-type electromechanical locks that must be stocked in inventory: the two different voltages (12 and 24 volts), for use with the two different standard voltages used in solenoid-type control systems, and the two different default states for the unpowered lock.

In the unpowered state, a "fail safe" solenoid lock is unlocked. When power is applied to the fail safe solenoid lock drive in the lock, a coil in the solenoid produces a magnetic field that moves a solenoid rod against the spring biasing pressure to lock the lock mechanism. To keep the lock continuously in the locked position, power must be continuously applied to the solenoid. When power is removed from the fail safe solenoid lock, the biasing spring returns the solenoid rod and the lock mechanism to the unlocked or "safe" position, allowing passage through the door.

Fail safe locks may be used, for example, in doors to public areas or building exits that are not normally used. In the event of a fire, the loss of power to the doors automatically unlocks such doors allowing safe passage therethrough during the emergency.

A "fail secure" solenoid lock has its solenoid rod biased in the opposite way. In the unpowered state it is in the locked state. When power is applied, the solenoid coil moves the solenoid rod against the spring biasing pressure to unlock the lock mechanism. With power removed, the biasing spring returns the lock mechanism to the locked or "secure" position.

Fail secure locks may be used, for example, in interior doors to high security rooms in the interior of the building. The locks on such interior doors are typically designed to allow egress from the locked room regardless of the locked or unlocked state of the lock mechanism on the door. The lock mechanism is designed to prevent unauthorized entry into the secured area from a hallway or public area, but does not prevent those within from exiting the secure area.

If power to the lock is interrupted for any reason the solenoid-type lock drive automatically returns to its default state and locks the door. Unless a key is used to manually operate the fail secure lock, it is not possible to enter the secured area even when power is intentionally cut to the lock mechanism.

One problem with the solenoid drive system for locks is that each of the four different types of locks (12 and 24 volt solenoids in fail safe and fail secure models) must be manufactured and held in inventory to meet the needs of customers. There is a need for a single lock mechanism drive capable of replacing each of the four different types of locks.

A related problem is that the four solenoid-type lock drives often require several components and/or internal connections within the lock mechanism. There is a need for a modularized lock drive to simplify manufacturing and reduce errors and assembly time.

Many solenoid-type lock drives include various sensors to detect the state of the door lock and the position of internal lock components. Sensors may be used to detect when the handle on each side of the door has been rotated, when the latchbolt is retracted or extended, etc. The installation and interconnection of these sensors during manufacturing is labor intensive and costly. There is a need for an improved interconnection and mounting of such sensors in combination with other improvements in the lock drive to integrate the installation.

Another problem with such prior art solenoid-type lock drives is the waste of power due to the need to keep the solenoid constantly powered. There are many applications where it is desirable to use a fail secure lock, but the lock must be held in the unlocked state for long periods, such as during an entire working day. There are also many applications where it is desirable to use a fail safe lock and the lock must remain locked during long periods.

By some estimates, up to forty percent of the time, solenoid locks are powered and the solenoid is held in the non-default state against the biasing force of the solenoid spring. There is a need for a lock drive that can reduce the energy cost of holding the lock in the non-default state, while still returning the lock to the default state when power is lost, as may happen in a power failure, during a fire or when power is intentionally cut in an attempt to access a secure area.

A related problem is that by constantly supplying power to a solenoid lock (to hold it in the non-default state), the lock is continuously dissipating power in the solenoid coil, which results in heating of the lock body. Although the lock and the solenoid coil can be designed for the heating produced in continuous duty operation, this heating is generally considered to be objectionable. The handle connected to such a lock may become objectionably warm and the heating may affect any nearby electronic components. There is a need for a lock mechanism that does not produce heat when held in the non-default state, but which can be operated with a 12 or 24 volt solenoid-type lock control system.

Solenoid-type lock drives have previously been used where power is continuously available. As such, low cost has been a primary motivating factor and energy conservation has not been properly considered. There is a need for a lock mechanism having a low power lock drive. that will function as a direct drop-in replacement for a solenoid-type lock without requiring replacement of its associated solenoid-type lock control system and which will have the same feature of returning to a known default state when power is removed. In particular there is a need for a low power lock drive which can be used in combination with an existing installed base of solenoid locks.

Solenoid locks move from the default state when power is applied. As they move, they store energy in a biasing spring in the solenoid. As long as the lock is powered, it remains in the non-default state and energy remains stored in the biasing spring. As soon as power is removed, the stored energy in the biasing spring drives the lock mechanism to its locked or unlocked default state.

Any low power replacement for this type of industry standard solenoid lock drive system must have this same basic operation—it must move from a default state to a non-default state when power is applied and it must return to the default state when power is removed.

One type of known low power lock drive system uses a motor to drive a locking element between locked and unlocked states. Motors have the advantage that they can sit unpowered for long periods after driving the locking element to the desired state. However low power motorized designs do not operate against a biasing spring that returns the lock to a default state. If a default spring were to be used, power would have to be supplied to hold the motor against the return spring.

Motorized drive type locks must be operated by a motorized drive type of control system that actively moves the lock between the locked and unlocked states. Although motorized drive type locks may be mechanically very similar to the four solenoid-type locks, the motorized drive type control system is significantly different. The motorized drive type control system must always provide power to the lock. To ensure that the lock is in a desired state, the lock control system must typically monitor the position of the motor or associated locking element. This active driving and monitoring for a motorized drive contrasts with the simplicity of a spring biased solenoid-type lock drive.

Motorized drive type locks are typically used in more expensive applications, such as in low power battery operated lock applications which use an electronic key. The electronic key may be a key card of the type used in many hotels, a keypad mounted on or near the door, an RFID or similar secure proximity detection system, a biometric-type identification system that matches fingerprints, iris patterns, voice or faces, etc. Typically, the electronics for deciding when the lock should be opened are located in a control lock housing that is separate from the housing for the mechanical components of the lock mechanism with its motorized lock. The motor in the motorized drive is located in the mechanical lock housing and installed with the lock. All other control electronics are typically located in a control housing mounted separately outside the mechanical lock housing and connected thereto by a control cable accessible only from inside the secure area.

In the motorized lock drive, wires connect the motor within the body of the lock mechanism to the housing for the control electronics. A battery is located in the control system housing, not the lock housing and the motorized control system provides all control signals to the motor inside the lock housing whenever it is necessary to drive the motor in the lock from one position to the other.

Although motorized lock drives for use in sophisticated battery operated systems are known, there is a need for a motorized lock drive with integrated control electronics located within the lock housing for direct replacement of solenoid locks. Unlike known motorized drive type locks, a suitable solenoid replacement lock drive must have the lock drive electronics within the lock housing or directly associated with the lock to allow for direct replacement of a solenoid lock.

Moreover, the control electronics for the motor must emulate the functionality of a solenoid lock by returning to a known default state in the absence of power. This combination of a low power motor drive and motor control to replace a solenoid lock, where the motor and motor control emulate solenoid functionality and are not intended for battery operation, but are intended for use in a solenoid system having the higher power of non-battery powered systems has not heretofore been available.

Known motorized locks intended for use with battery operated designs make efficient use of the battery power because the lock drive motor uses no power unless it is changing state.

However, it has been found that the mechanical efficiency of conventional motorized locks is also less than is desirable. This reduced mechanical efficiency results in an undesirable excess power loss each time the lock changes state due to the need to overcome excess friction.

More specifically, the motor axis of conventional motor drive systems is not axially aligned with the motion of the locking element or the axis of rotation of the lock hub. The motor of such conventional designs is offset from the line of motion of the locking element. To move the locking element, the motor must drive a lever, offset spring or other mechanical interconnect instead of driving the locking slide directly. The force produced by the motor in known motorized lock drives is offset from the desired direction of motion of the locking element.

This offset requires some type of interconnecting element between the lock drive motor and the locking element. It has not heretofore been recognized that this offset and the interconnecting element produce significant friction that must be overcome and decreased performance.

There is a need for a motorized lock drives with improved mechanical efficiency in both battery operated and solenoid replacement applications. More specifically, there is a need for a low power, motorized lock drive and/or a motorized lock drive that emulates a solenoid-type lock drive in which the motor is positioned in a direct line with motion of the locking element and/or the rotation of the lock hub to reduce mechanical inefficiency of the lock drive.

The prior art offset axis motorized lock drive system for battery operated applications represents a fifth type of lock mechanism that must be manufactured and held in inventory in addition to the four solenoid-type lock mechanisms. None are interchangeable with the other as each is designed for a different application or a different type of lock control system. All of the five types may have substantially the same type of mechanical lock components and hardware with only the electronic drive system being different, but all five types must be held in inventory. There is a need for a lock drive that can easily be switched between each of the four solenoid types, and preferably, also to the motor drive type in order to reduce inventory costs.

As described above, known motorized drive control systems must send specific signals whenever it is necessary to lock or unlock the mechanism. This operation has the advantage of reduced power usage because no power is used except when the lock drive is changing state. However, motorized lock drives do not rely upon the lock to return to a default state and cannot be used to replace a solenoid lock controlled by a solenoid-type lock control system.

The solenoid-type lock control system has only two states—power on and power off. Thus a solenoid-type lock control system is significantly different from a motorized drive lock control system and a lock mechanism with a motorized lock drive is not suitable for use with the control system for a lock mechanism having a solenoid-type lock drive. It would be desirable to be able to remove a solenoid lock that spends much of its time powered on and replace it with a drive having a motorized drive system that spends substantially all of its time in the unpowered state.

However, a lock mechanism having a motorized lock drive of the type described above cannot directly replace a solenoid-type lock due to the differences between the required control systems.

Disclosure of Invention

Bearing in mind the problems and deficiencies of the prior art, it is therefore an object of the present invention to provide a motorized lock drive capable of emulating a solenoid lock drive to allow direct substitution of an efficient motorized lock for a solenoid lock without changing the solenoid lock control system.

It is another object of the present invention to provide a lock drive that is more electrically and/or mechanically efficient than known motorized lock drives and known solenoid lock drives.

A further object of the invention is to provide a lock drive capable of emulating multiple different solenoid lock drives operable on different voltages and switchable between fail safe and fail secure default states.

It is yet another object of the present invention to provide a lock drive that is modular and can be installed during manufacture as an integrated modular lock drive unit to reduce manufacturing costs.

Still other objects and advantages of the invention will in part be obvious and will in part be apparent from the specification.

The above and other objects, which will be apparent to those skilled in the art, are achieved in the present invention which is directed to a lock drive for mounting within a lock housing that includes a reversible motor having a shaft defining a motor axis, an auger driven by the motor, a lock spring engageable by the auger and a sliding locking element moveable from a locked position to an unlocked position, the locking element being connected to the lock spring, the sliding motion of the locking element defining a slide axis in axial alignment with the motor axis.

The lock spring moves the locking element to the locked position when the motor rotates the auger in a first direction. The lock spring drives the locking element to the unlocked position when the motor rotates in the opposite direction. The lock spring is compressed and stores energy when the locking element is blocked from motion to the locked position, such as when the handle of the lock is partially turned and is being held in that position. This allows the locking element to subsequently move into locking engagement in the locked position when the handle is released.

A control circuit is preferably mounted to the lock housing and connected to a solenoid type combined power and control input to control the motor and emulate a solenoid lock by driving the locking element to a non-default locked or unlocked state when power is applied and to a default locked or unlocked state when power is removed. The control circuit includes a microcontroller, an energy storage mechanism and a switch connected to the microcontroller for selecting the default locked or unlocked state of the lock.

In another aspect of the invention, the lock drive is modular and is intended for installation in lock housing having a rotatable lock hub. The modular lock drive includes a lock drive housing mountable within the lock housing. A reversible motor is mounted within the lock drive housing. The motor has a shaft defining the motor axis and an auger is mounted on that shaft. A lock spring is engaged by the auger and a locking element is slidably mounted in the lock drive housing to move from a locked position that prevents rotation of the lock hub to an unlocked position in which the lock hub is free to rotate.

The locking element is connected to the lock spring. The sliding motion of the locking element defines a slide axis in axial alignment with the motor axis. This "inline" positioning alignment ensures low friction and allows a relatively small motor to be used, which, in turn, allows the motor to fit within the limited space available in the lock housing for an inline aligned positioning where in the motor axis is aligned with the slide axis and the rotational axis of the locking hubs.

The lock spring drives the locking element to the locked position when the motor rotates in a first direction. It drives the locking element to the unlocked position when the motor rotates in the opposite direction and the lock spring stores energy to subsequently move the locking element when the locking element is blocked from motion to the locked position.

In another aspect of the invention, the lock motor, auger, lock spring and locking element are mounted within the lock drive housing and installable during manufacture as a modular lock drive.

In a further aspect of the invention, the control circuit is operable on 12 volts and 24 volts so that it can be used to replace locks and/or lock drives controlled by 12 volt and 24 volt solenoid control systems by replacing the lock without any change tot eh lock control system.

In a preferred aspect of the invention, the motor, auger, lock spring, locking element and control circuit are mounted within a lock housing and the lock slide axis and motor axis are perpendicular to a lock hub axis of rotation within the lock housing.

When mounted horizontally and perpendicular to the lock hub axis of rotation, space is extremely limited. Accordingly, in still another aspect of the invention, when the slide axis and motor axis are substantially horizontal within the lock housing, the lock drive has a horizontal length (measured from the motor to the locking element with the locking element in the retracted/unlocked position) of less than 2.0 inches (50.8 millimeters) to fit horizontally into the lock housing between the lock hub and a vertical wall of the lock housing.

In the most highly preferred embodiment of the invention, with the slide axis and motor axis horizontal, the lock drive has a horizontal length (as measured above and not including the control circuit) of less than 1.25 inches (31.75 millimeters).

In a further aspect, the motor is a DC motor operable on less than five volts. Preferably the DC voltage of the motor is 2 volts. This low voltage is very efficient, and the inline aspect of the invention allows the reduced torque and power of the motor to reliably operate the drive, while also allowing an extremely small size, as needed to fit within the limited space available inside the lock housing when the motor is oriented with its axis inline with the slide axis of the locking element.

In another optional aspect of the design, the control circuit is designed to allow the lock drive to emulate five different lock drives including: four solenoid lock drives and a motorized lock drive.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 9 is a side elevational view showing the inline lock drive in the locked state. The locking element of the inline lock drive is engaged with a slot in the mortise lock hub to prevent rotation of the lock hub.

FIG. 10 is a side elevational view showing the inline lock drive in the unlocked state. The locking element of the inline lock drive is disengaged from the slot in the mortise lock hub.

FIG. 11 is a side elevational view showing the inline lock drive in the blocked motion state. The motor and auger have rotated to compress the spring, but the motion of the locking element has been blocked by a partial rotation of a handle connected to the lock hub. The partial rotation of the lock hub has moved the locking slot in the lock hub out of alignment with the locking element. The spring of the lock drive has been compressed by the auger and will drive the locking element into locking engagement with the locking slot in the hub when the handle is released to return the hub to the default aligned position without any further action by the lock drive.

FIG. 12 shows the lock drive in the locked state. FIG. 13 shows the lock drive in the unlocked state.

FIG. 17 shows the motor connected directly to a circuit board implementing electronics simulating operation of a solenoid corresponding to the lock drive control circuit block diagram of FIG. 15.

FIG. 18 shows the motor of the inline motorized lock drive provided with a connector for connection to a circuit board mounted elsewhere inside or on the exterior of the lock housing so that the lock may directly replace a solenoid lock with the lock housing fitting within the same mounting space of a removed solenoid lock.

DESCRIPTION OF THE PREFERRED EMBODIMENT

In describing the preferred embodiment of the present invention, reference will be made herein to FIGS. 1-18 of the drawings in which like numerals refer to like features of the invention.

Figure 1:
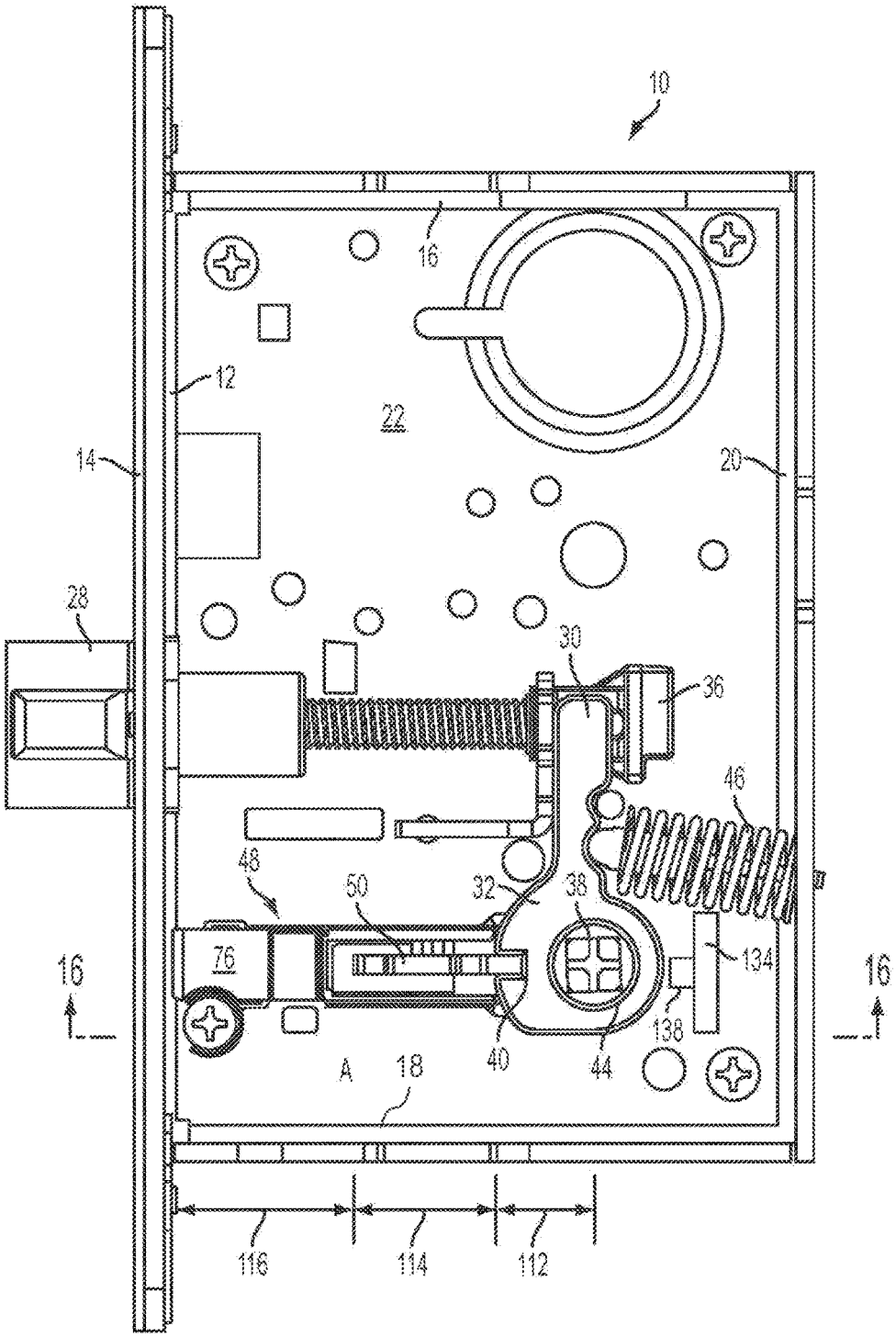
FIG. 1 is a right side elevational view of a mortise lock incorporating an inline motorized lock drive according to the present invention. The mortise lock side cover plate, on the right side of the lock, has been removed to show internal components of the lock, including the motorized lock drive of the present invention. Some conventional internal lock components not relevant to operation of the invention have also been removed to simplify the drawing. An electronic control circuit board located within the mortise lock housing for simulating operation of a solenoid drive and connections between the motor of the lock drive and the control circuit have also been omitted, but may be seen in FIGS. 16 and 17.

Referring to FIG. 1, a mortise lock 10 includes a front wall 12, preferably covered by a decorative face plate 14, a top wall 16, a bottom wall 18, a back wall 20 and a left side wall 22. The five walls and plates 12, 16, 18, 20 and 22 are preferably formed from a single sheet with the surrounding walls being bent upwards to form an open rectangular body for the lock housing. The lock body holds the internal lock components within it and the body is then enclosed with a removable cover plate 24 on the right side to form the final wall of the complete lock housing.

The cover plate 24 forming the right side of the lock housing has been removed in FIG. 1 to show various internal components of the lock, including the location of the inline motorized lock drive 26 of the present invention. Various other conventional internal lock components, not relevant to operation of the invention, have also been removed to simplify the drawing. These include the deadbolt, guard bolt, levers for operating the deadbolt and guard bolt, the key cylinder etc.

Such components and their positions and operations are well known to those of skill in this art. U.S. Pat. No. 5,678,870 (the '870 patent), which is assigned to Sargent.

Manufacturing Company, and is incorporated herein by reference, provides a detailed description of a mechanically operated lock having the components omitted from FIG. 1.

The lock 10 is provided with a conventional latch bolt 28, which is retracted by an arm 30 extending outward from lock hub 32 when the hub 32 is rotated by its corresponding handle. In FIG. 1 only the right side lock hub 32 can be seen. However, as can be seen by referring to the cross sectional view of FIG. 16, the lock is conventionally provided with both the right side lock hub 32 and a left side lock hub 34.

The two lock hubs are independently rotated by their corresponding handles. One hub and handle will be located on the secure side of the door, and the other will be located on the opposite side. Arm 30 of lock hub 32 bears against the tail 36 of the latch bolt 28 when lock hub 32 is rotated clockwise. This hub rotation acts to retract the latch bolt 28.

Lock hub 32 can be rotated by a spindle 38 located in the center of the lock hub 32. Spindle 38, on the right side of the lock, has a conventional square cross section and engages its corresponding handle on the exterior of the door to allow the handle to directly drive its associated lock hub and retract the latch bolt 28. Lock hub 34 on the left side of the lock has a separate corresponding square spindle extending into the handle on the left side of the door.

Although the two lock hubs 32 and 34 rotate about the same axis of rotation, they are connected to separate spindles and rotate independently to independently operate the two lock hubs. This allows each hub to be separately locked and unlocked as will be further described below.

Each lock hub has a corresponding locking slot to provide for independent locking. Lock hub 32 has locking slot 40 formed on its perimeter and the hub rotates about a central bearing 44 as its corresponding spindle 38 is rotated by the handle connected thereto.

Although it is not shown in detail in the drawings, lock hub 34 also has a corresponding locking slot and bearing.

When lock 10 is unlocked, lock hub 32 can be rotated clockwise by its corresponding handle. As the lock hub rotates, it compresses return spring 46 and arm 30 bears on the latchbolt tail 36 to retract the latchbolt 28. When the corresponding handle is released, the hub and latchbolt return to the position seen in FIG. 1.

The action described above is entirely conventional, but must be understood to understand the context of the present invention. A more detailed description of this type of lock operation can be found in the '870 patent referred to above. The most relevant aspects thereof are also described below.

The '870 patent discloses a mechanically operated lock (non-electrified) in which the locking mechanism that controls the blocking or interfering engagement between the locking slots and the locking element is moved entirely by hand to lock and unlock the lock mechanism. The locking element in the locking mechanism is driven by hand into and out of engagement with either one or both of the locking slots in the two lock hubs to prevent or allow rotary motion and thereby prevent or allow the latchbolt to be retracted to open the door.

By rotating the locking piece into a different orientation, either side of the lock can be the secure side of the lock and either one of the lock hubs can be the lock hub that is affected by the locking mechanism. The locking piece can be rotated from outside the housing, without disassembling the lock to gain access to the internal lock components and without removing any associated screws or components that might be lost.

This allows the lock to be easily switched from a left handed lock to a right handed lock. If desired, the locking piece in the '870 design can also be rotated so that both hubs are locked (the locking piece engages both lock hub slots) when the lock mechanism slides the locking piece into locking engagement.

Figure 5:
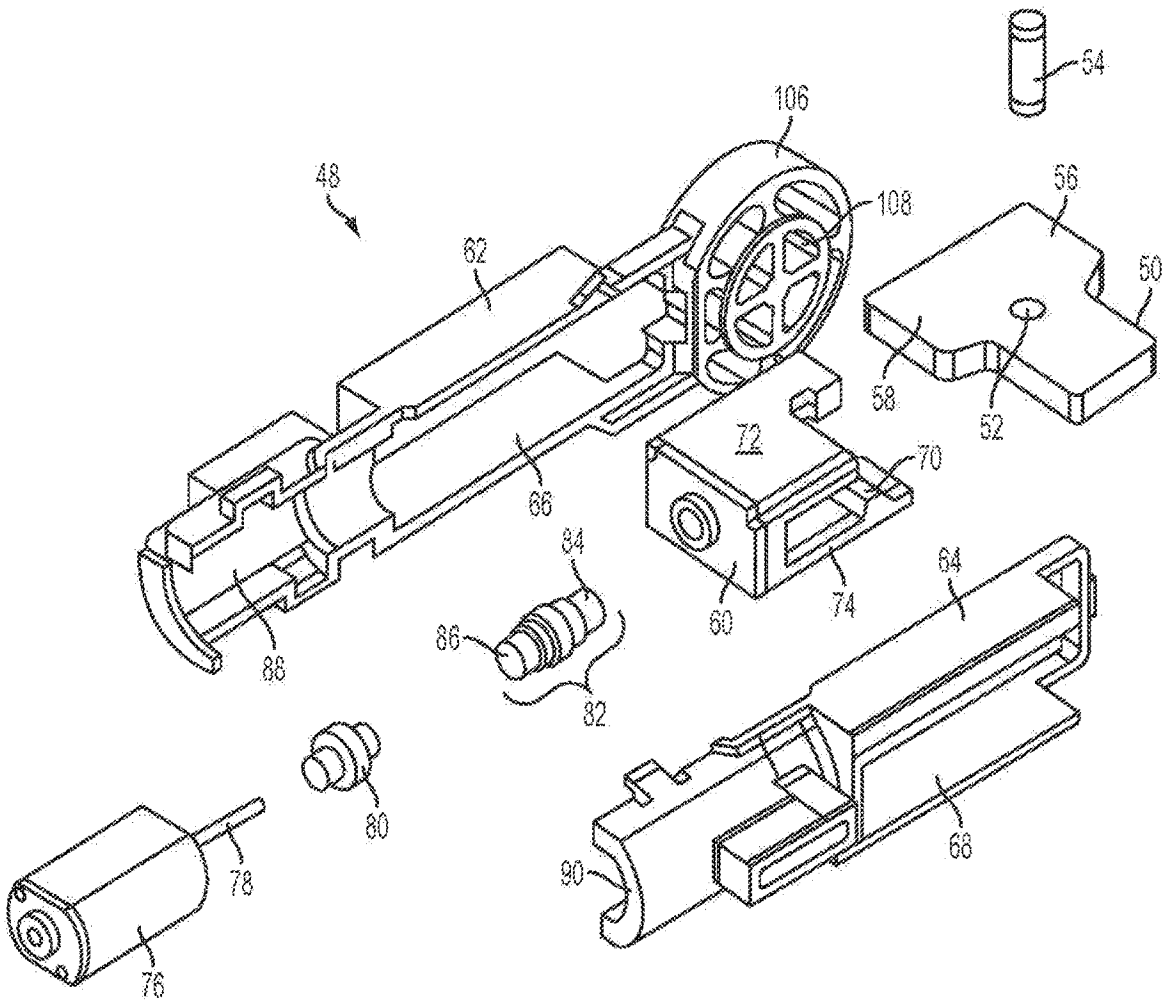
FIG. 5 is an exploded perspective view of the inline motorized lock drive module seen in FIG. 2. The lock spring 82 and auger 80 are shown in generic block outline form in this view. Details of these items can be seen in FIGS. 6 and 7 respectively.

The inline motorized lock drive 48 of the present invention is shown best in the exploded view of FIG. 5. FIG. 1 shows the relative location of the lock drive 48 to the lock hubs.

The mechanically operated locking mechanism in the '870 patent is approximately located at or below where the lock drive 48 of the present invention is shown in FIG. 1 and in the space below the lock drive 48 in FIG. 1. Solenoid operated versions of that lock also position the solenoid approximately at or below where the lock drive 48 is shown in FIG. 1.

However, in motorized versions of the lock, the motor has heretofore been located below the position indicated in FIG. 1 for the lock drive 48. More specifically, the axis of the motor used in motorized versions has heretofore not been aligned with the sliding motion of the lock mechanism (described below) and has not been pointed towards or aligned with the axis of rotation of the handles and spindle 38.

Instead, previous motorized versions have positioned the motor of the motorized lock drive below the line of sliding motion for the locking element 50 in the area generally marked with an "A" in FIG. 1. This area provides significant additional room for a motor of sufficient size to operate the locking mechanism and to accommodate the linkages necessary to transfer the motor drive to the locking mechanism. Solenoid drives also use the area "A" to accommodate the solenoid lock drive.

Referring to FIGS. 1 and 5, the present invention uses a "T" shaped locking element 50 that is substantially identical to the locking element disclosed in the '870 patent. Locking element 50 is preferably planar and has a central locking element bearing 52 so that it can be rotated around a vertical axis formed by locking element pivot pin 54.

When locking element 50 is rotated to one orientation, one arm of the "T" will slide into and out of locking engagement with the locking slot for its corresponding hub as the mechanical locking mechanism is moved from the locked position to the unlocked position. As shown in FIG. 5, arm 56 is oriented to slide into and out of engagement with the locking slot in lock hub 34. The sliding motion of the locking element into and out of locking engagement is along a line that is directly inline with the axis of rotation of the lock hubs 32, 34.

When rotated one hundred eighty degrees around, the "T" shape of the locking element is reversed and the opposite arm of the "T", arm 58 will engage lock hub 32 instead of lock hub 34 when in the locked position. The locking element 50 can also be rotated 90 degrees so that both arms 56 and 58 of the "T" engage and disengage from the corresponding locking slots in the lock hubs. In this orientation, lock arm 56 will engage locking slot 40 in lock hub 32 and lock arm 58 will engage the locking slot in lock hub 34.

Locking element 50 is held within shuttle 60. Shuttle 60 is slidingly held within the lock drive 48 so that it can move towards and away from the locking hubs. The lock drive includes a lock drive housing 62 having a lock drive cover 64. When the lock drive housing and lock drive cover are assembled, the lock drive 48 is an integrated modular component that slidingly holds the shuttle in a track having a left side 66 located inside lock drive housing 62 and a right side 68 of the shuttle track inside lock drive housing cover 64.

The locking element 50 is wider than the shuttle 60 and also slides in slots formed in the lock housing side walls 22, 24. The locking element 50 is sized so that in any of the three possible orientations, it is approximately as wide as the outer width dimension of the lock housing and when partially rotated, it is wider that the lock housing. The slots in the lock housing side walls 22, 24 that the locking element slides within also function to provide external access to the locking element 50 before the lock 10 is installed so that the lock may be easily converted from a right-handed lock to a left-handed lock mechanism.

With a screwdriver, key or other reasonably strong and narrow implement, the locking element 50 can be pushed upon where it is accessible in the exterior slots of the lock housing side walls 22, 24. This acts to rotate the locking element 50 around pin 54. As the locking element begins to rotate, it will be slightly wider than the lock housing, making it easier to complete the turn.

The shuttle 60 is provided with at least one protrusion 70 on its interior that engages a corresponding indentation on the underside of the locking element 50. This engagement occurs only when the locking element is in a desired orientation, such as in the orientation shown in FIG. 5 or in the 180° opposite orientation.

The shuttle 60 is preferably made of a resilient plastic and has a "U" shaped cross section. The upper half 72 of the shuttle and the lower half 74 are substantially parallel. The bottom surface of the upper half 72 is approximately in contact with the upper surface of the locking element 50. The top surface of the lower half 74 is provided with protrusion 70 so that the top surface of the lower half 74 is in contact with the lower surface of the locking element 50 when the locking element is in a desired alignment and protrusion 70 is engaged with the corresponding locking element indentation on the underside of the locking element 50.

As the locking element 50 begins to partially rotate, the protrusion 70 moves out of the matching indentation on the underside of the locking element 50. This causes the legs 72 and 74 of the "U" shaped shuttle to resiliently spread apart with a spring-like action. As the locking element 50 approaches its final desired orientation, protrusion 70 will approach a corresponding indentation on the underside of the locking element. The spring-like action of the spread-apart legs 72 and 74 of the shuttle will cause the protrusion 70 to snap into the approaching indentation on the underside of the locking element 50.

With the protrusion 70 engaged with an indentation, the upper 72 and lower 74 halves of the shuttle will again be substantially parallel and aligned. Thus, the protrusion 70 and the spring action of the shuttle act to hold the locking element 50 continuously in the desired orientation. Those with skill in this art will recognize that multiple protrusions may be formed on either side of the shuttle and the locking element 50 may be provided with various indentations for any desired preset orientation. The protrusions may alternatively be formed on the locking element on either side thereof with the indentation being formed on the shuttle inner surfaces.

The sliding motion of the shuttle causes the locking element 50 to move into and out of blocking engagement with a selected one or both of the lock hubs, depending on the orientation of the locking element 50. In order to lock the lock hub 32, the shuttle must be driven towards the lock hub to move the arm 58 of the "T" shaped locking element into slot 40 in the locking element 50.

Figure 9:
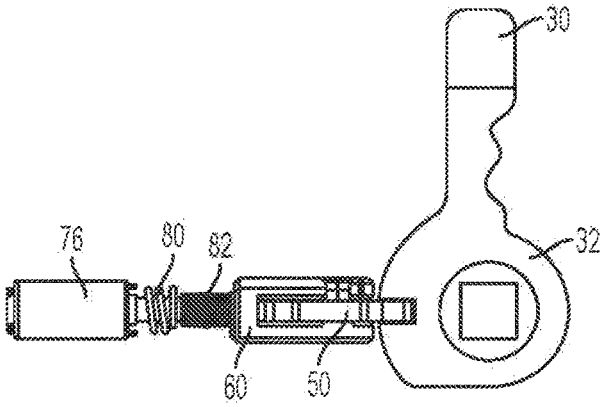
FIGS. 9-11 show the interaction between the inline motorized lock drive of the present invention and at least one of the lock hubs in the mortise lock. The Figs, show different locked and unlocked states. The lock module housing seen in FIGS. 2, 3 and 5 has been removed to better illustrate this operation.
Figure 10:
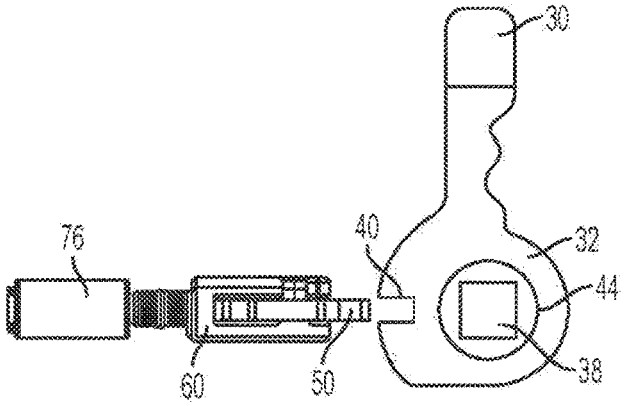

FIG. 9 shows the locking element 50 inserted into slot 40 in the lock hub 32. To disengage the locking element 50 from lock hub 32, the sliding shuttle 60 and the locking element 50 must be driven in the opposite direction. This is shown in FIG. 10.

The shuttle 60 is driven forward (locked) and back (unlocked) with motor 76. The motor 76 drives motor shaft 78 in rotary motion in either a clockwise or counterclockwise direction. The motor is preferably a DC motor and the polarity of the DC signal controls the rotary direction of the motor.

An auger 80 is mounted on the motor shaft 78. The auger 80 has a thread pitch and diameter that allows it to engage at least a portion of a lock spring 82. The right end 84 of the lock spring 82 is securely attached to the shuttle 60. The left end 86 of the spring 82 is threaded onto the auger 80.

The motor 76 is fixed inside the motor mounts 88, 90 in the housing 62 and housing cover 64 respectively so that the motor does not move with respect to the lock housing. When the motor is driven clockwise (as seen looking along the motor shaft from the left of FIG. 5), it threads the auger into the spring, which pulls the spring and shuttle 60 towards the motor to unlock the lock mechanism. This is shown in FIG. 10.

When polarity of the drive is reversed, the motor is driven counterclockwise and the spring 82 is driven away from the motor by the threaded auger. Provided the locking slot 40 is aligned with the locking element 50 this will drive the locking element 50 into the locking slot 40 to lock the lock mechanism. This locked state is shown in FIG. 9.

The locking slot 40 will be aligned with the locking element 50 if the handle is not partially rotated, i.e. if it is not being held with return spring 46 compressed and the latchbolt partially retracted. If the handle is being held open against the return spring pressure when the motor is driven counterclockwise, the locking slot 40 will not be aligned with the locking element 50. In that case, the auger will compress the spring, storing energy therein and hold the locking element 50 against the perimeter of the lock hub 32 until the handle is released.

Figure 11:
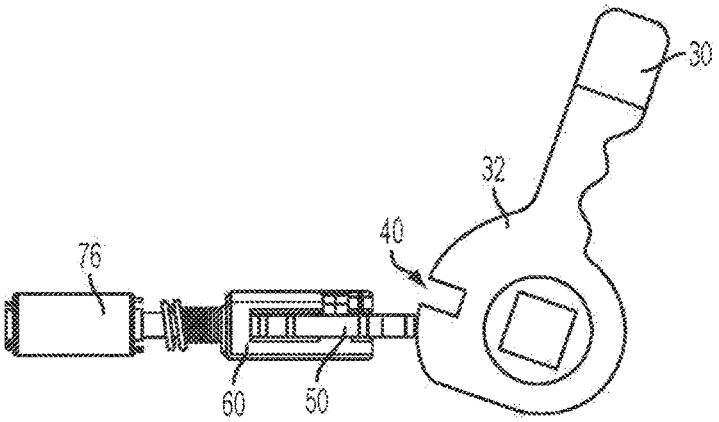

This blocked position is shown in FIG. 11. As soon as the handle is released, the return spring 46 will drive the lock hub 32 back to the position seen in FIGS. 9 and 10 and the stored energy in lock spring 82 will drive the locking element 50 into locking slot 40 to lock the lock mechanism.

Figure 12:
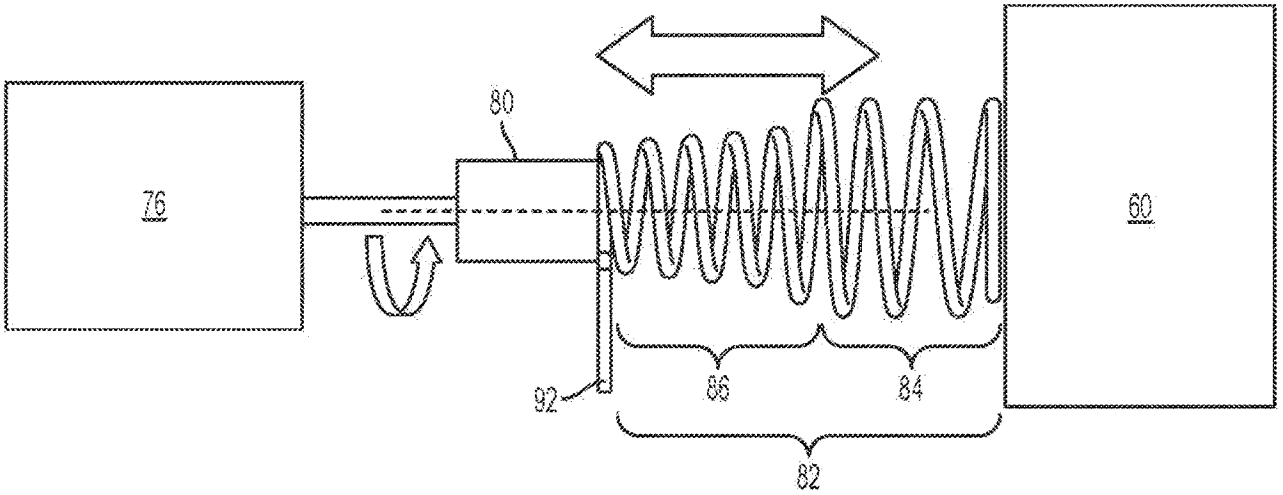
FIGS. 12 and 13 show the relative positions of the motor, auger, spring and lock drive of the invention in different states. The position of the auger 80 is shown as a block and details of the auger design are not shown, but may be seen in FIGS. 7 and 8.
Figure 13:
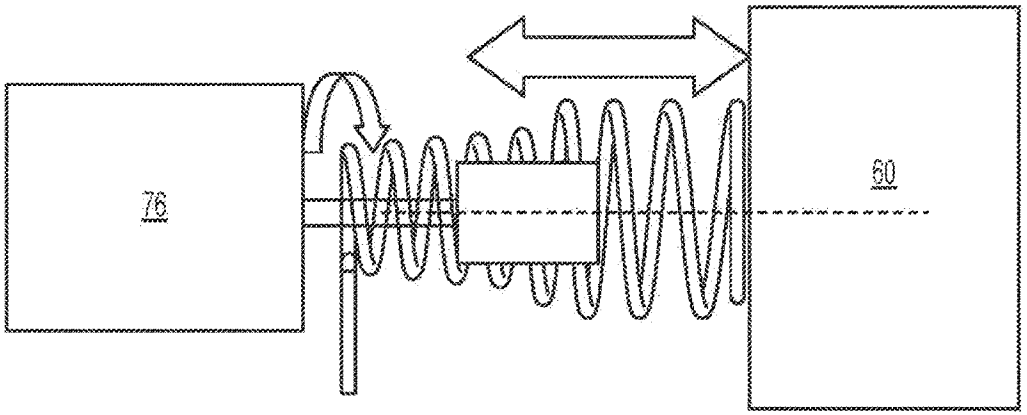

The lock spring 82 is provided with the shape illustrated in FIGS. 12 and 13. At the left end 86, the diameter of the spring is reduced as compared to the enlarged diameter of the right end 84. When the auger is in spring region 86, the diameter of the spring is such that the spring coils engage the threads of the auger. See FIGS. 7 and 8 for reference to the threads on the auger 80 which engage the spiral coils of the spring 82. The auger is shown only generically as a block in FIGS. 12 and 13 to illustrate its position with respect to the spring. When the auger turns, spring portion 86 will be driven along the threads of the auger to move the entire spring 82. Spring 82 is prevented from rotating by its connection to the shuttle 60 and/or the extended spring end 92, which slides in a corresponding slot in the lock drive housing 62, 64.

In the spring region 84, however, the increased diameter of the lock spring 82 is such that the auger can spin inside the spring without driving the spring left or right. This disengagement between the auger and lock spring is a first aspect of the improved efficiency of the present invention. When motor 76 is driven counterclockwise, as shown in FIG. 12, the shuttle 60 and locking element 50 will move away from the motor 76. auger 80 will then thread off the end of the lock spring 82, disengaging the threads of the auger from the coils of spring 82 in spring region 86.

This disengaging action allows the motor and auger to spin. A freely spinning motor draws less current and uses less power than a motor that is stalled and/or prevented from turning. The motor 76 is driven by the control system for a slight excess of the time required to ensure that the locking element has reached the desired locked position, seen in FIG. 12. The excess drive time, after the locking element has reached the locked position, requires very little excess power due to the disengagement of auger threads from the spring coils.

The disengaging action described above also minimizes the risk that the motor will jam or become stuck at the end of the spring. This is important when the motor used is an extremely low power motor, which is preferred in this invention to maximize efficiency.

A second aspect of the improved efficiency of the present invention can be seen in the design of the spring 82 at its enlarged diameter end 84. When the motor 76 is driven clockwise, as shown in FIG. 13, the auger 80 will thread into the enlarged diameter region 84 at the right side of spring 82 and the auger will again disengage from the spring by spinning freely within the enlarged diameter region 84 of the spring. Again, this disengagement reduces energy consumption and increases efficiency. It also functions to prevent the motor and auger from jamming at the end of the spring nearest the shuttle 60.

Figure 6:
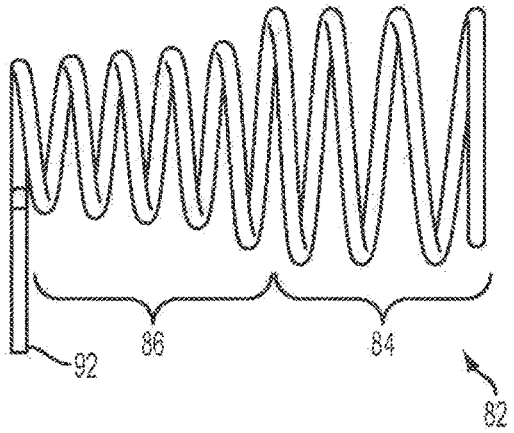
FIG. 6 is a right side elevational view, shown at an increased scale, of the lock spring used in the inline motorized lock drive module seen in FIGS. 2 and 5.

FIG. 6 shows the spring 82 with its enlarged diameter end 84 and smaller diameter end 86. The smaller diameter end 86 loosely engages the auger, allowing the auger threads to move the spring and shuttle towards and away from the lock hubs. This design allows the auger to disengage from the spring in both directions. In one direction, disengagement is achieved by driving the auger until it threads off the spring coil end and in the other direction, disengagement is achieved by enlarging the diameter of the spring so that the auger spins freely within the coils of the spring. This double disengagement design improves efficiency by preventing the motor from stalling and improves reliability by decreasing the risk of jamming.

Figure 7:
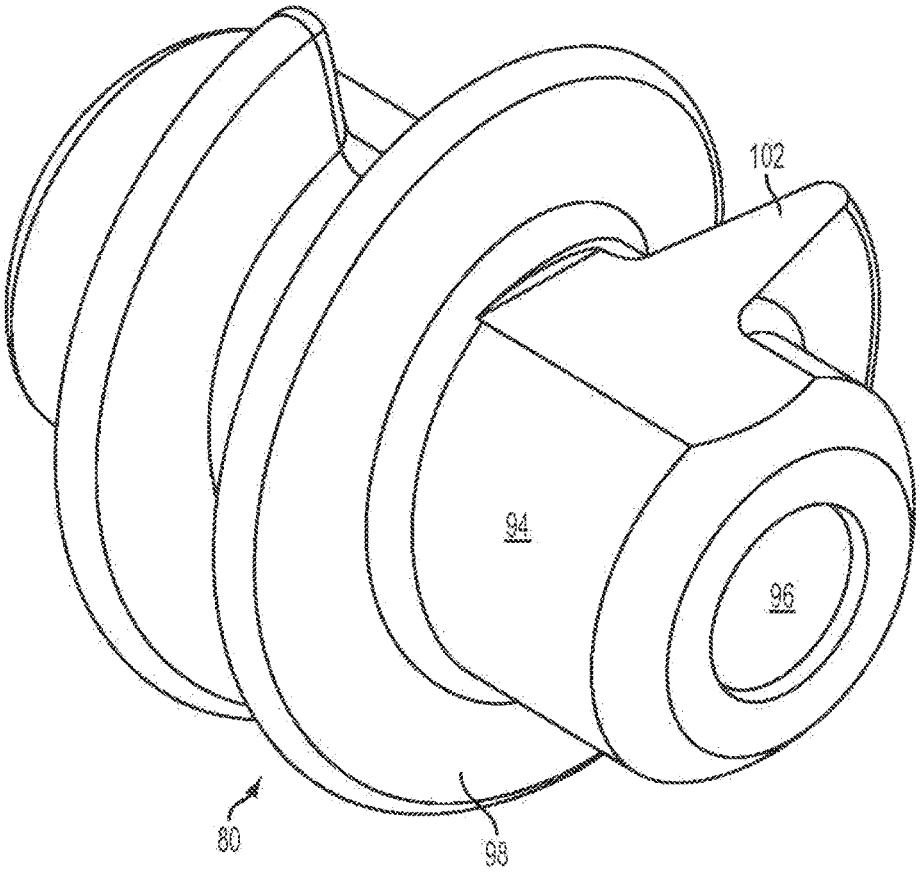
FIG. 7 is a perspective view, shown at an increased scale, of the auger used in the inline motorized lock drive module seen in FIGS. 2 and 5. The auger engages the spring seen in FIG. 6.
Figure 8:
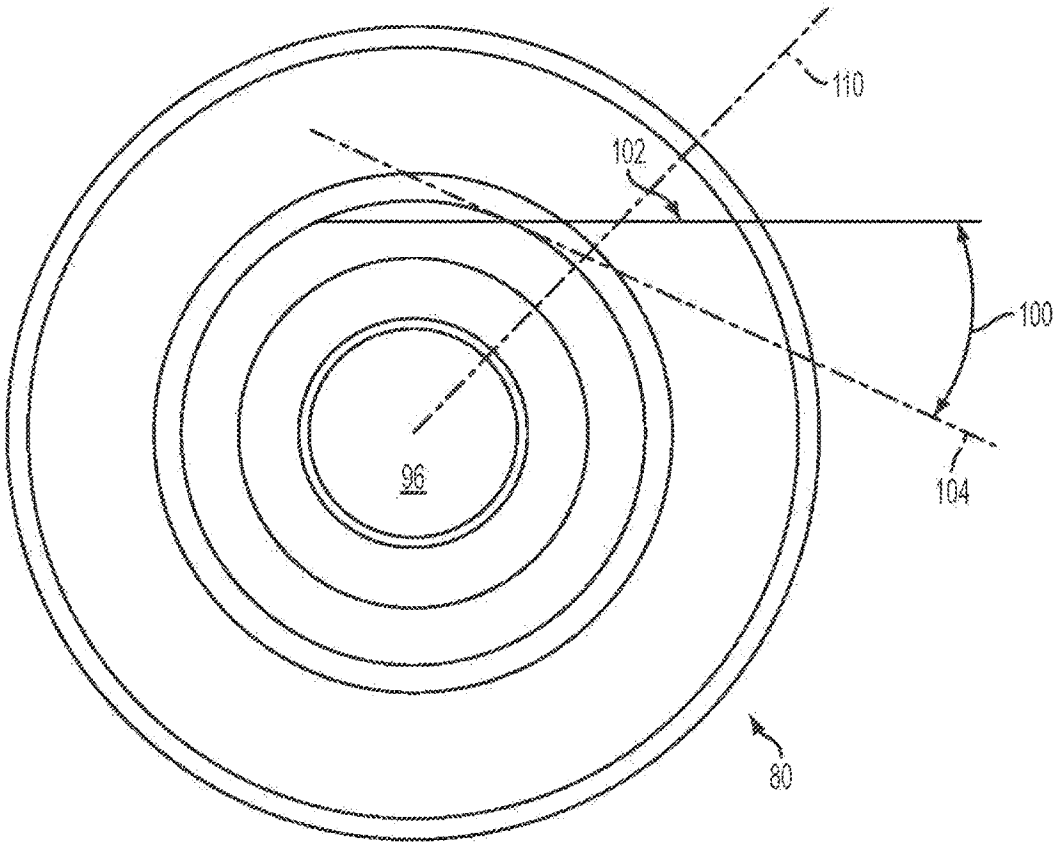
FIG. 8 is a front elevational view of the auger in FIG. 7. The auger is shown looking along the rotational axis of the auger to show the lead-in angle of the auger threads.

FIGS. 7 and 8 show the auger 80 and its improved design, which cooperates with the spring 82 to increase reliability after the spring and auger have disengaged as described above. auger 80 includes a body 94 and a central, axially oriented shaft bore 96 that receives the shaft 78 of motor 76 for mounting the auger thereon.

The auger threads 98 extend in a spiral around the body of the auger 80 and have a pitch that matches the pitch of the coils of spring 82 in spring region 86 so that the auger can drive the spring as the motor turns.

Improved performance of the auger 80 is achieved by providing the threads of the auger 80 with a relatively "shallow" lead-in angle 100 that is less than ninety degrees. The auger threads start at surface 102. As measured in a plane perpendicular to the rotation axis (as shown in FIG. 8) and relative to a tangent line 104 to the cylindrical auger body, the lead-in surface 102 has a lead-in angle 100 that is significantly less than ninety degrees.

It has been found that with a lead-in angle of ninety degrees (lead-in surface 102 parallel to a radial line 110 from the motor axis at the center of shaft bore 96) the motor will spin the auger so quickly that the auger thread 98 may fail to engage the spring threads when disengaged as described above. Each time the lead-in surface 102 approaches the first spiral of the spring, the contact is sufficient to resiliently push the spring away from the auger, or bounce the spring slightly away, preventing the auger from engaging the spring. The rotation of the motor is so fast that this bouncing or pushing action occurs repeatedly, once each rotation, and the auger fails to engage the spring.

By making the lead-in angle more shallow (less than ninety degrees, measured as in FIG. 8) the spring and auger will re-engage more reliably. The preferred lead-in angle is 45°, however other angles will also work to improve reliability of re-engagement, provided that they are less than ninety degrees as defined above.

Although the auger shown in the drawings is the preferred design for this invention, alternative types of s augers, such as a single pin that engages the spring coils, or a flat plate to engage the coils may also be used. In the most highly preferred embodiment of this invention, however, the component driving the spring, whether it be an auger as shown, a single pin auger or other type of auger, will disengage from the spring at each end to allow the motor to freewheel and thereby reduce energy use and minimize the chance of the driving component (auger, etc.) becoming stuck in the spring and unable to extract itself due to the low power of the efficient motor used to achieve energy efficiency.

Figure 2:
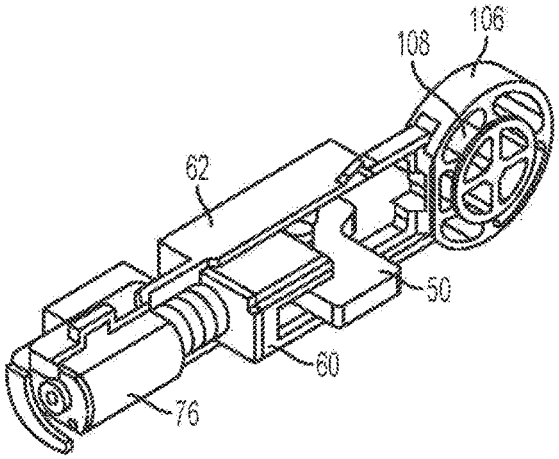
FIG. 2 is a perspective view from the upper right of the inline motorized lock drive module seen in FIG. 1.
Figure 3:
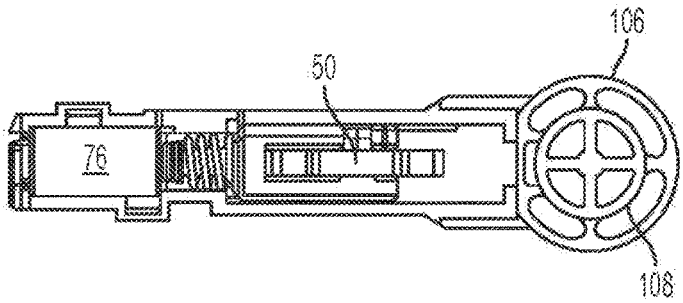
FIG. 3 is a right side view of the inline motorized lock drive module seen in FIG. 2.
Figure 4:
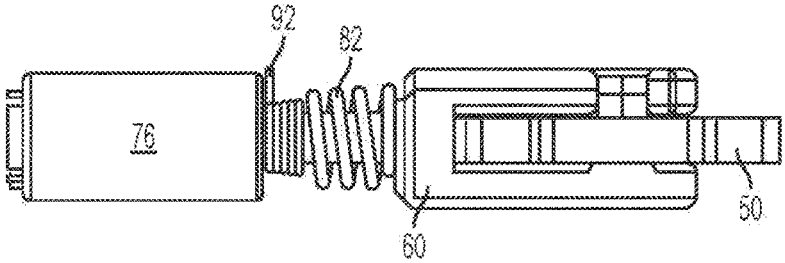
FIG. 4 is a right side view of the inline motorized lock drive seen in FIGS. 2 and 3 with the modular lock drive housing removed.

In FIG. 5, the motorized lock drive is shown exploded. In FIGS. 2 and 3, it is shown assembled into its preferred modular design, except that the housing cover 64 has been removed. In FIG. 4 the entire modular housing has been removed. These drawings show the relative position of the internal components previously described.

When fully assembled, the motorized lock drive is a modular unit that can simply be placed into the lock body as a unit instead of requiring individual components to be separately installed.

In addition to holding the components in a modular unit, the lock drive housing is provided with a spacer 106 at the right end of the modular unit and a lock hub bearing 108. When the lock mechanism is assembled, the lock hubs 32, 34 are positioned on opposite sides of the spacer 106. Each lock hub is provided with an inward recess forming a central bearing 44 that engages the outwardly projecting lock hub bearing 108.

The housing and its lock hub bearing are preferably made of plastic to provide a rugged and quiet bearing surface around the perimeter of the bearing 108 where the lock hubs rotate. By integrating the lock hubs into the modular lock drive the axial alignment of the motor shaft 78 with the rotation axis of the lock hubs is ensured.

The modular design also ensures that the motor axis is aligned with the sliding motion of the locking element 50. By aligning the motor axis with the sliding motion of the locking piece, friction is significantly reduced as compared to prior art designs in which the motor axis is offset from the axis of motion of the locking piece. This alignment ensures that all the force produced by the motor is used to achieve the desired motion of the locking piece, instead of being partially wasted by moving through a linkage, an offset spring arm, or other mechanism for transferring the force of the motor to the locking element.

When the locking piece motion and motor axis are not aligned, it is necessary to use a lever, a spring arm or the like to transfer the motor force. Previously it has been believed to been necessary to use such an offset motor design to provide sufficient room for a motor powerful enough to move the locking element. The prior art offset motor design typically positions the motor below the sliding line of motion of the locking element—in the area marked "A" of FIG. 1. A linkage, such as a spring arm is then used to move the locking element in the desired sliding motion.

It has been found that by placing the motor in the axially aligned position shown in the drawings, the power required is reduced, and this reduction in power requirements allows a smaller motor to be used, which then allows the motor to fit within the limited space for the motor shown in FIG. 1. Thus, the effect of this alignment is a significant reduction in motor power requirements by eliminating mechanical friction.

More specifically, with the inline design, the motor has been reduced from five volts to two volts. The present invention is usable as both a solenoid replacement design with control electronics embodied within the lock housing 10 and as a replacement for motorized designs.

In the solenoid replacement aspect, as will be described below, the control board mounted within the lock housing 10 simulates the performance of a solenoid by storing electrical energy, instead of spring energy, to return the lock to a default position when power is removed, in the same way that a solenoid returns to its default position when power is removed.

The reduction in power requirements from the inline design results in a reduction in the required energy storage, which reduces costs and typically allows a smaller energy storage component, such as a capacitor, to be used. This is advantageous as the space within the lock housing 10 is extremely limited.

It will be understood that even though solenoid locks typically have access to significant amounts of power—as required to drive a solenoid, when they are replaced with the present invention, the reduction in power usage is still desirable as it increases the energy efficiency of any building in which the locks are installed.

The inline lock drive module described above may also be used to replace less efficient existing motorized lock drives where the motor is not "inline" and is offset from the line of motion of the locking element. Motorized locks are conventionally used in battery powered applications. The increased efficiency of the inline design described above allows a significant increase in battery life in such applications.

Referring to FIG. 1, the lock hub 32 has a radius 112 of approximately 0.6 inches (15.24 mm). The locking element 50 requires space 114 that is approximately equal to the width of the lock at 0.9 inches (22.86 mm). This places severe limitations on the space available 116 for an inline motorized lock drive. In the most highly preferred design, the lock drive including the motor 76, motor shaft 78, auger 80, lock spring 82 and the portion of the shuttle prior to the locking element must fit within the lock drive space 116.

Figure 14:
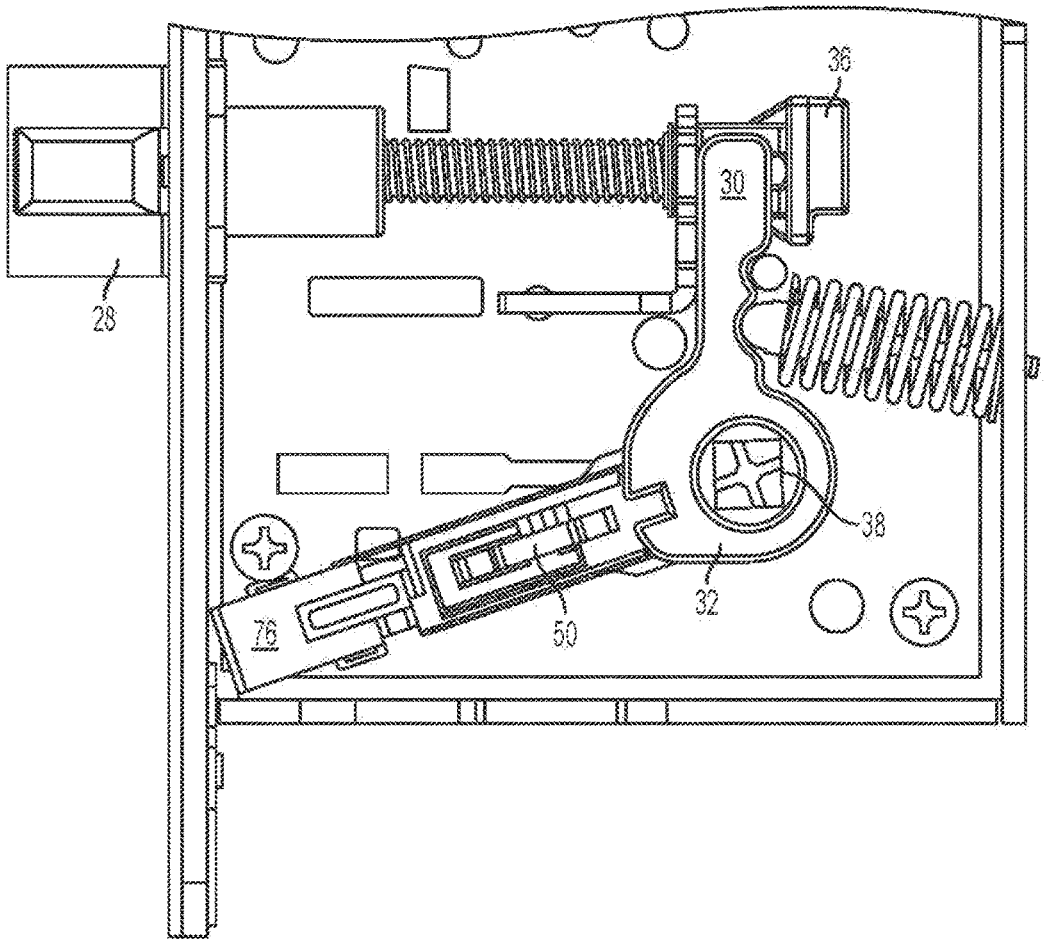
FIG. 14 shows the lower half of a lock housing illustrating an alternative angled mounting for the inline motorized lock drive module of the present invention. The angled mounting provides additional axial room to mount the lock drive of the invention within the lock housing while still providing the increased mechanical efficiency and other advantages of inline mounting.

In the preferred design, the lock drive space 116 is less than 1.25 inches (31.75 mm), and will be less than 2 inches (50.8 mm) even if the alternative design seen in FIG. 14 is employed, in which the inline motorized lock drive is shifted from horizontal down into the space marked "A" in FIG. 1.

It will be noted that even in the angled design of FIG. 14, the motor axis is directly inline with the sliding motion of the locking element. This produces a very balanced force on the sliding locking element 50. The locking element slides within the track defined by the modular housing around it, but the track provides almost no force on the locking element due to the balanced design.

Because the locking element 50 is aligned with the driving force, it may be said to float within the limits of the track in contrast to offset motor designs where the track is required to constrain the locking element which is moved with an offset force derived from the offset motor. This floating action produces the efficiency of the present design, allowing reduced motor power as friction is reduced. This, in turn, allows the motor to be smaller and less powerful than previous motor designs, which then allows the motor to fit within the very limited space available.

Figure 17:
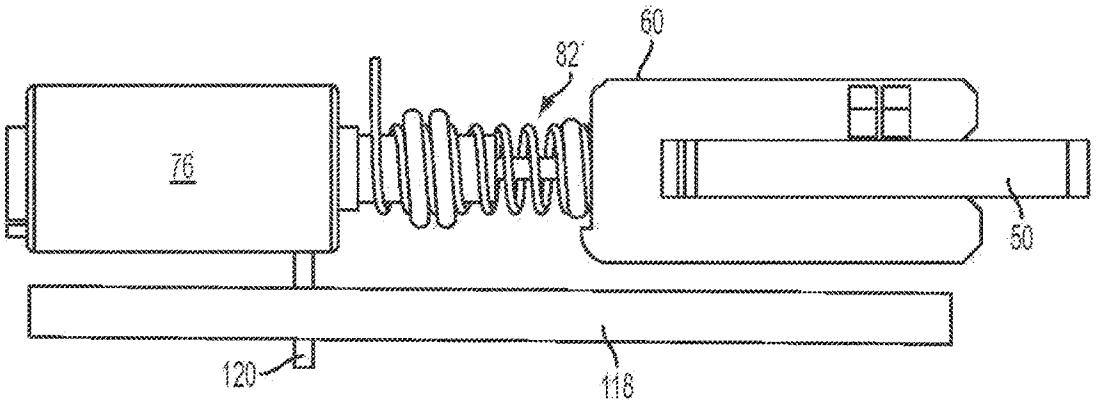
FIGS. 17 and 18 show an alternative non-modular embodiment of the inline motorized lock drive of the present invention. The motor and sliding locking element are separately mounted rather than being integrated into a single installable module.
Figure 18:
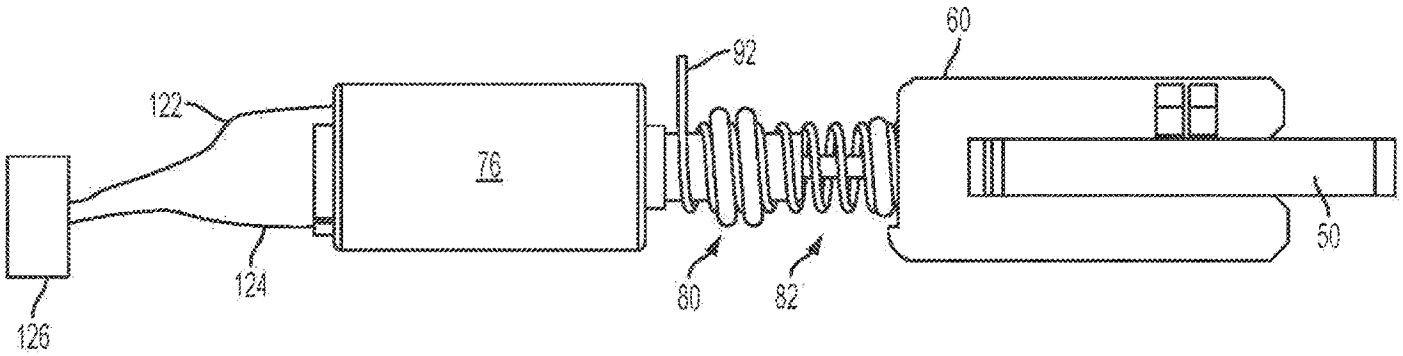

Although the preferred embodiment uses lock drive housing 62 and cover 64, the inline lock drive invention may also be implemented with individually mounted components as shown in FIGS. 17 and 18.

In FIG. 17, the motor is directly mounted to a circuit board 118 mounted within the lock housing 10 with leads 120 that may be directly soldered to the board 118 or inserted into a connector mounted thereon.

In FIG. 18, the motor 76 is provided with flexible wires 122, 124 that run to a connector 126. Although FIGS. 17 and 18 are intended to illustrate a non-modular design, they may also viewed as showing possible electrical interconnections for the modular design, except that the lock drive housing 62 and lock drive housing cover 64 have been omitted for clarity. The possible electrical interconnections are substantially the same.

In the embodiments shown in FIGS. 17 and 18, a conventional constant diameter spring 82' is shown instead of the two diameter spring 82 previously described. It can be seen that the auger engages the spring 82' at both ends of the spring. When the auger is driven counterclockwise, it freewheels off the left end of the spring 82'. However, when the auger is driven clockwise, it will drive to the right and stop against the shuttle 60.

Although the spring 82' will work, it does not provide the reduced power advantages of the preferred design in which the auger freewheels at both ends due to the enlarged diameter of the spring 82 at end 84. Moreover the spring 82' present some risk that the auger will drive so tightly into the spring coils at the right side that it will have insufficient power to extract itself when reversed, leading to a malfunction.

In conventional motorized designs, the problems of jamming or failure to reengage are of sufficient concern that even though battery power usage is critically important, the lock motor is driven twice by the motorized control system to ensure that the locking element is driven to the correct location. The present invention has improved performance so that this double drive is not required. This adds a further efficiency to the present invention as compared to conventional motorized designs.

The connector 126 in FIG. 18 is intended in the present invention to run to a circuit board mounted within the lock housing 10 when the present invention is in its solenoid replacement aspect to simulate solenoid operation. However, wires 122 and 124 may be made much longer to be connected externally to a battery powered motorized control system if the lock is to be used with a conventional motorized lock drive controller.

As will be described below, in the solenoid replacement embodiment, the circuit board 118 will provide control signals to emulate the operation of a solenoid. More specifically, it will have an electrical energy storage component, such as a capacitor, supercapacitor, battery or the like that stores sufficient energy to drive the high efficiency motor drive system to a default state when it senses that power is removed form the lock.

This design allows the lock 10 to perfectly emulate a solenoid lock and to function as a drop-in replacement for a solenoid lock, without any change to the solenoid type electrical control system for the lock.

Further, the solenoid emulating circuit within the lock housing 10 is designed to be easily switchable between "fail safe" and "fail secure" by throwing a switch or jumper or software setting on the control circuit within the lock housing 10. In addition, the power system is designed to accept both 12 and 24 volts. In this way, a single lock according to the present invention is able to be used in any one of the four conventional solenoid lock systems. It can function as either "fail safe" or "fail secure" at either 12 or 24 volts. This immediately reduces inventory requirements and errors in supplying the wrong lock to a customer while simplifying manufacturing and allowing easy changes in the field to accommodate different applications for a solenoid lock.

Because the lock appears to an external solenoid lock control system exactly like a solenoid lock, it may be interchanged with a solenoid lock and used with other solenoid locks. In particular, it may be used to replace solenoid locks that are continuously held in the solenoid "on" state, while the solenoid locks that are normally in their default off state may be retained. This significantly reduces the energy consumption of the entire lock system without needing to replace the solenoid control system or those solenoid locks that operate most efficiently in their default "off state.

Figure 16:
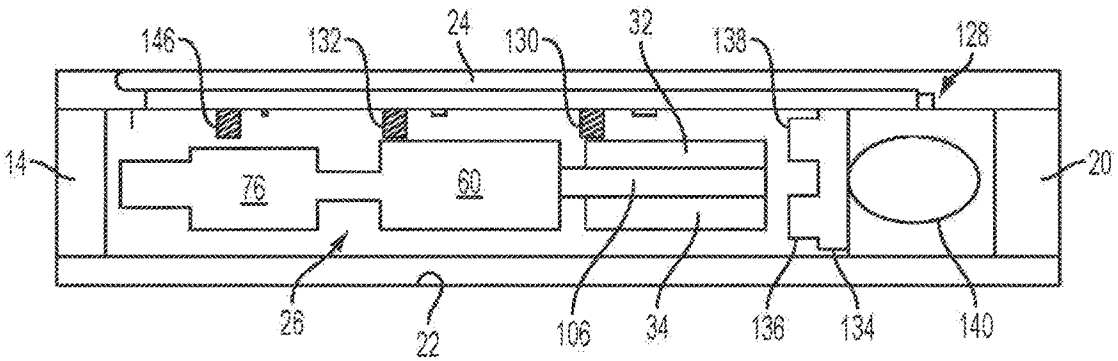
FIG. 16 is a cross section taken along the line 16-16 of FIG. 1 showing a preferred mounting for a circuit board within the lock mechanism housing of FIG. 1. The circuit board includes electronics simulating operation of a solenoid corresponding to the lock drive control circuit block diagram of FIG. 15. The cross section of FIG. 16 is taken with the lock mechanism cover installed whereas in FIG. 1, the cover has been removed to show the interior of the lock.

FIG. 16 provides a cross section through the lock in FIG. 1 looking upward towards the inline motorized lock drive of the present invention. In the preferred aspect of this invention, the lock housing 10 includes a control circuit board 128 recessed into the cover plate 24. Components, such as components 130 and 132, are preferably surface mounted on only one side of the circuit board 128 so that the back side is substantially flat and fits into a correspondingly shaped recess in the lock housing cover 24.

The circuit board preferably used with this invention is of the type recessed in the lock cover plate 24 as disclosed in pending U.S. patent application Ser. No. 12/712,643, filed Feb. 25, 2010, which is incorporated herein by reference. The circuit board may also be provided with one or more sensors mounted thereon, which may extend upwards into the lock to sense the position of lock components.

Alternatively, sensors, such as sensors 136 and 138, may be mounted to a second circuit board 134, as shown in FIG. 16 and FIG. 1. The second circuit board is connected along an edge to the primary control circuit board 128. The sensors 136 and 138 are then positioned adjacent to the lock hubs 34 and 32. The lock hubs are preferably provided with magnets and the sensors are magnetically sensitive reed switches or Hall Effect sensors which detect when the hubs have turned.

Additional space behind the sensor circuit board 134 is available for a capacitor or other energy storage mechanism 140, such as a battery or the like. The energy storage mechanism 140 is used to emulate the operation of a solenoid lock by storing energy needed to drive the motor and operate the control circuit on the circuit boards. When incoming power is removed from the lock, the control circuit senses this change and uses remaining power from the energy storage component 140 to drive the motor lock mechanism to the desired default state.

Figure 15:
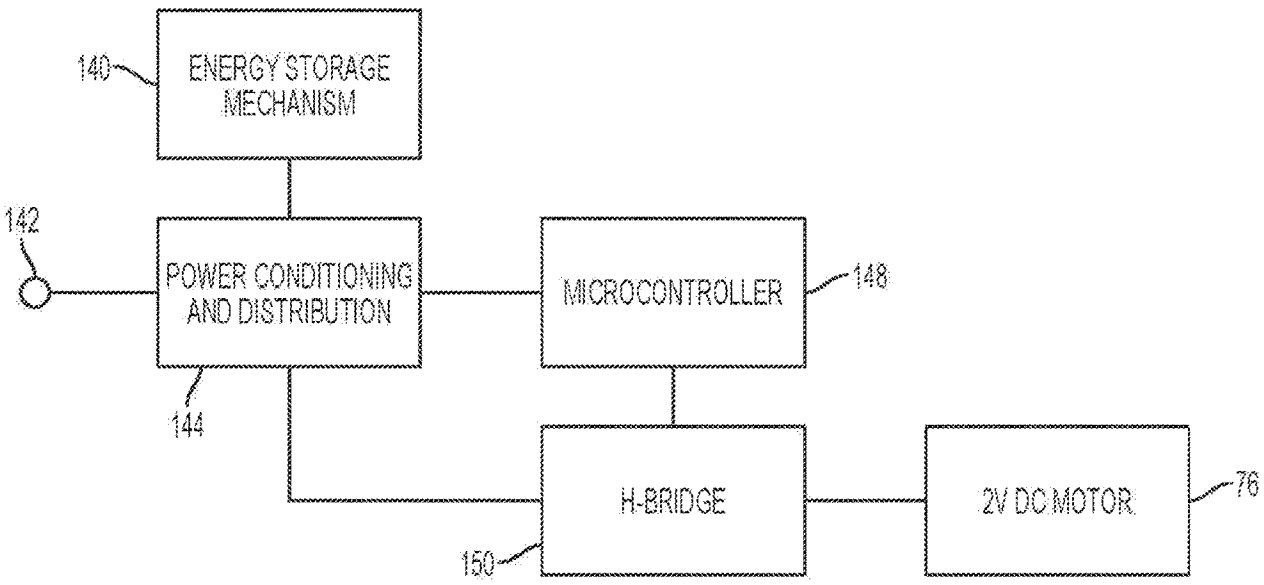
FIG. 15 is a block diagram of a lock drive control circuit for the inline motorized lock drive of the present invention.

This operation is described in FIG. 15 which shows how the lock mechanism control circuit emulates a solenoid lock. Power is provided to the lock in a conventional way at solenoid type combined power and control input 142. Power and control are combined in a solenoid type control system because power is applied only when the solenoid lock is to move to its non-default state.

The applied power will be either 12 or 24 volts and will move the lock to the non-default state when power is applied and to the default state when power is removed ("fail safe" or "fail secure"). To emulate the function of a solenoid lock, power is stored so that the lock can return to the default state when power is removed.

The power from input point 142 is applied to a power conditioning and distribution circuit 144. The power conditioning and distribution circuit 144 sends power to the energy storage mechanism 140, to a microcontroller 148 and through an H-bridge 150 (under the control of microcontroller 148) to the motor 76.

The power conditioning and distribution circuit 144 ensures that power spikes do not harm the circuit. It accepts both 12 and 24 volts and converts the same to a lower voltage for driving the microcontroller 148 and the motor 76, which is preferably a 2 volt DC motor, and performs other typical power control tasks.

When emulating a solenoid lock, the input point 142 will only be provided with power when the solenoid control system connected thereto wishes the lock to drive to the non-default state. The default state is determined by a switch 146 mounted on the circuit board 128, which is accessible from the exterior of the lock to set the type of solenoid lock ("fail safe" or "fail secure") that the lock is to emulate. The switch shown in the drawings may be mounted at any desired convenient location. It may protrude through an opening in the lock case to allow it to be easily switched. It may be operated by inserting a wire through an opening, by moving a jumper on the circuit board, by changing a software setting or by any other known type of switching method.

The microcontroller 150 will wait until enough power has been stored in the energy storage mechanism 140 to ensure that the lock can return to its preset default "fail safe" or "fail secure" state before the motor 76 is driven. Once the microcontroller determines that the energy storage mechanism 140 has sufficient power to return the lock to its default state, it will drive motor 76 through H-bridge 150 to the non-default state (determined by the selectable switch 146 monitored by the microcontroller 148). The H-bridge 150 allows the highly efficient DC motor 76 to be driven in either direction.

Because the power conditioning circuit converts both 12 and 24 volts to desired lower operating voltages, and because the circuit can easily be switched between "fail safe" and "fail secure", a single lock mechanism can function as any one of the four conventional solenoid type locks currently manufactured and held in inventory.

It is also possible to integrate the functions of motorized locks into the circuitry of the primary control circuit board 128. This makes the present invention usable in battery powered non-solenoid applications and allows a single lock to perform all the functions of the five major types of locks (four solenoid and one motorized). This significantly reduces inventory and manufacturing costs.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A lock drive-for mounting within a lock housing comprising:

a reversible motor having a shaft defining a motor axis;

an auger-shaped member attached to the shaft and driven by the motor;

a lock spring engageable by the auger-shaped member, the spring being prevented from rotation by an extended spring end sliding in a corresponding slot in a lock drive housing;

a sliding locking element slidably moveable from a locked position to an unlocked position, the locking element being connected to the lock spring, the sliding motion of the locking element defining a slide axis in axial alignment with the motor axis;

the lock spring driving the locking element to the locked position when the motor rotates in a first direction, the lock spring driving the locking element to the unlocked position when the motor rotates in an opposite direction and the lock spring storing energy to subsequently move the locking element to the locked position when the locking element is blocked from motion; and a control circuit mountable to the lock housing and configured to control the motor to slide the locking element to the locked or unlocked position in a non-default state, in which power is applied to the motor, and in a default state, in which power to the motor is removed, the control circuit including a microcontroller, an energy storage mechanism and a switch connected to the microcontroller for selecting the non-default or default states of the motor.

2. The lock drive according to claim 1 wherein the control circuit is operable on 12 volts and 24 volts.

3. The lock drive according to claim 1 further including a lock drive housing wherein the motor, auger shaped member, lock spring, and locking element are mounted in the lock drive housing, and wherein the lock drive housing provides a modular lock drive.

4. The lock drive according to claim 1 wherein the auger-shaped member includes threads engaging coils of the lock spring and the threads of the auger-shaped member disengage from the coils of the lock spring after the motor rotates in the first direction to drive the locking element to the unlocked position and the threads of the auger-shaped member also disengage from the coils of the lock spring after the motor rotates in the opposite direction to drive the locking element to the unlocked position.

5. The lock drive according to claim 4 wherein the lock spring is enlarged at one end to allow the threads of the auger-shaped member to disengage from the coils of the lock spring at the enlarged end of the lock spring.

6. The lock drive according to claim 1 wherein the auger-shaped member includes threads having a lead-in angle of less than ninety degrees for engaging the lock spring.

7. The lock drive according to claim 1 in combination with the lock housing wherein:

the lock housing includes a rotatable lock hub defining a lock hub axis of rotation;

the motor, auger-shaped member, lock spring, and lock element mounted within the lock drive housing, and the control circuit are mounted within the lock housing;

the slide axis and motor axis are perpendicular to the lock hub axis of rotation; and the control circuit is operable on 12 volts and 24 volts.

8. The lock drive according to claim 7 wherein the slide axis and motor axis are substantially horizontal within the lock housing and the lock drive has a horizontal length from the motor to the locking element of less than 2.0 inches (50.8 millimeters) when the locking element is retracted so as to fit horizontally into the lock housing between the lock hub and a vertical wall of the lock housing.

9. The lock drive according to claim 7 wherein the slide axis and motor axis are substantially horizontal within the lock housing and the lock drive has a horizontal length from the motor to the locking element of less than 1.25 inches (31.75 millimeters) when the locking element is retracted so as to fit horizontally into the lock housing between the lock hub and a vertical wall of the lock housing.

10. The lock drive according to claim 1 wherein the motor is a DC motor operable on less than five volts.

11. A lock drive for mounting within a lock housing having a rotatable lock hub, the lock drive comprising:

a lock drive housing mountable within the lock housing;

a reversible motor mounted within the lock drive housing, the motor having a shaft defining a motor axis;

an auger-shaped member driven by the motor;

a lock spring engageable by the auger-shaped member, the spring being prevented from rotation by an extended spring end sliding in a corresponding slot in the lock drive housing;

a locking element slidably mounted and slidably movable within the lock drive housing and moveable from a locked position to prevent rotation of the lock hub and an unlocked position, allowing rotation of the lock hub, the locking element being connected to the lock spring, the sliding motion of the locking element defining a slide axis in axial alignment with the motor axis; and the lock spring driving the locking element to the locked position when the motor rotates in a first direction, the lock spring driving the locking element to the unlocked position when the motor rotates in an opposite direction, and the lock spring storing energy to subsequently move the locking element to the locked position when the locking element is blocked;

the lock motor, auger-shaped member, lock spring and locking element being mounted within the lock drive housing and installable during manufacture as a modular lock drive.

* * * * *